US010941499B2

(12) United States Patent
Waqar et al.

(10) Patent No.: US 10,941,499 B2
(45) Date of Patent: Mar. 9, 2021

(54) ELECTRODEPOSITION OF AL—NI ALLOYS AND AL/NI MULTILAYER STRUCTURES

(71) Applicant: UNIVERSITY OF SOUTH FLORIDA, Tampa, FL (US)

(72) Inventors: Ammar Bin Waqar, Tampa, FL (US); Wenjun Cai, Tampa, FL (US)

(73) Assignee: UNIVERSITY OF SOUTH FLORIDA, Tampa, FL (US)

( * ) Notice: Subject to any disclaimer, the term of this patent is extended or adjusted under 35 U.S.C. 154(b) by 102 days.

(21) Appl. No.: 15/749,165

(22) PCT Filed: Jul. 29, 2016

(86) PCT No.: PCT/US2016/044689
§ 371 (c)(1),
(2) Date: Jan. 31, 2018

(87) PCT Pub. No.: WO2017/023743
PCT Pub. Date: Feb. 9, 2017

(65) Prior Publication Data

US 2018/0223443 A1 Aug. 9, 2018

Related U.S. Application Data

(60) Provisional application No. 62/199,464, filed on Jul. 31, 2015.

(51) Int. Cl.
*C25D 5/18* (2006.01)
*C25D 5/12* (2006.01)
(Continued)

(52) U.S. Cl.
CPC ..... *C25D 5/18* (2013.01); *C25D 3/12* (2013.01); *C25D 3/54* (2013.01); *C25D 3/56* (2013.01);
(Continued)

(58) Field of Classification Search
CPC .... C25D 5/18; C25D 5/12; C25D 5/14; C25C 3/665; C25C 3/56; C25C 3/54; C25C 3/12
See application file for complete search history.

(56) References Cited

U.S. PATENT DOCUMENTS 5,552,241 A * 9/1996 Mamantov ..... C25C 3/00 252/62.2
2006/0272949 A1 12/2006 Detor et al.
(Continued)

OTHER PUBLICATIONS

Stafford, G.R. and C.L. Hussey, Electrodeposition of transition metal-aluminum alloys from chloroaluminate molten salts. Advances in Electrochemical Science and Engineering, vol. 7, 2002. 7: pp. 275-347 (Year: 2002).*
(Continued)

*Primary Examiner* — Louis J Rufo
(74) *Attorney, Agent, or Firm* — Thomas Horstemeyer, LLP

(57) ABSTRACT

A method for electrodepositing aluminum and nickel using a single electrolyte solution includes forming a mixture comprising nickel chloride and an organic halide, adding aluminum chloride to the electrolyte solution in an amount at which the mixture becomes an acidic electrolyte solution, providing a working electrode and a counter electrode in the acidic electrolyte solution, and applying a waveform to the counter electrode using cyclic voltammetry to cause aluminum and nickel ions to be deposited on the working electrode.

14 Claims, 7 Drawing Sheets

(51) Int. Cl.

| | |
|---|---|
| ***C25D 3/66*** | (2006.01) |
| ***C25D 3/12*** | (2006.01) |
| ***C25D 3/54*** | (2006.01) |
| ***C25D 3/56*** | (2006.01) |
| ***C25D 5/14*** | (2006.01) |

(52) U.S. Cl.
CPC ..... *C25D 3/665* (2013.01); *C25D 5/12* (2013.01); *C25D 5/14* (2013.01)

(56) References Cited

U.S. PATENT DOCUMENTS

2011/0083967 A1* 4/2011 Ruan ..... C25D 3/66 205/238
2011/0180413 A1* 7/2011 Whitaker ..... C25D 5/10 205/170
2012/0118745 A1 5/2012 Bao
2013/0168258 A1* 7/2013 Nakano ..... C25D 3/665 205/261
2014/0374263 A1 12/2014 Cai et al.

OTHER PUBLICATIONS

Roeper, D.F., K.I. Pandya, G.T. Cheek, and W.E. O'Grady, The Structure of Nickel Chloride in the Ionic Liquid 1-Ethyl-3-methyl Imidazolium Chloride/Aluminum Chloride: X-ray Absorption Spectroscopy. Journal of the Electrochemical Society, 2011. 158(3): (Year: 2011).*
Ali, M.R., A. Nishikata, and T. Tsuru, Electrodeposition of Al—Ni intermetallic compounds from aluminum chloride-N-(n-butyl)pyridinium chloride room temperature molten salt. Journal of Electroanalytical Chemistry, 2001. 513(2): pp. 111-118 (Year: 2001)*
Zhao, Y.G. and T.J. VanderNoot, Electrodeposition of aluminium from room temperature AlCl3-TMPAC molten salts. Electrochimica Acta, 1997. 42(11): pp. 1639-1643 (Year: 1997).*
International Search Report for PCT/US2016/044689 dated Oct. 2, 2016.
Waqar, "Exploration of Electrodeposition of Aluminum-Nickel Alloys and Multilayers in Organic Chloroaluminate Ionic Liquids", Graduate Theses and Dissertations, 2014.
Stafford, G.R. and C.L. Hussey, Electrodeposition of transition metal-aluminum alloys from chloroaluminate molten salts. Advances in Electrochemical Science and Engineering, vol. 7, 2002. 7: pp. 275-347.
Inoue, A., Amorphous, nanoquasicrystalline and nanocrystalline alloys in Al-based systems. Progress in Materials Science, 1998. 43(5): pp. 365-520.
Li, M., Z. Wang, and R.G. Reddy, Electrodeposition of Nickel in 1-Butyl-3-Methylimidazolium Tetrafluoroborate Ionic Liquids Journal of the Electrochemical Society, 2014. 161(4): pp. D150-D153.
Inoue, A. and H. Kimura, Fabrications and mechanical properties of bulk amorphous, nanocrystalline, nanoquasicrystalline alloys in aluminum-based system. Journal of Light Metals, 2001. 1(1): pp. 31-41.
Cai, F. and C. Jiang, Influences of Al particles on the microstructure and property of electrodeposited Ni—Al composite coatings Applied Surface Science, 2014. 292: pp. 620-625.
Moffat, T.P., Electrodeposition of Ni1-xAlx in a chloroaluminate melt. Journal of the Electrochemical Society, 1994. 141(11): pp. 3059-3070.
Ali, M.R., A. Nishikata, and T. Tsuru, Electrodeposition of Al—Ni intermetallic compounds from aluminum chloride-N-(n-butyl)pyridinium chloride room temperature molten salt. Journal of Electroanalytical Chemistry, 2001. 513(2): pp. 111-118.
Matsuda, T., S. Inoue, and T. Namazu, Self-propagating explosive Al/Ni flakes fabricated by dual-source sputtering to mesh substrate. Japanese Journal of Applied Physics, 2014. 53(6): pp. 1-5.
Kuk, S.W., H.J. Ryu, and J. Yu, Effects of the Al/Ni ratio on the reactions in the compression-bonded Ni-sputtered Al foil multilayer. Journal of Alloys and Compounds, 2014. 589: pp. 455-461.
Kjartansdottir, C.K., L.P. Nielsen, and P. Moller, Development of durable and efficient electrodes for large-scale alkaline water electrolysis. International Journal of Hydrogen Energy, 2013. 38(20): pp. 8221-8231.
Higashi, K., Positive exponent superplasticity in advanced aluminum alloys with nano or near-nano scale grained structures. Materials Science and Engineering a-Structural Materials Properties Microstructure and Processing, 1993. 166(1-2): pp. 109-118.
Tacikowski, M., R. Sitek, K. Sikorski, and T. Wierzchon, Structure of Al—Ni intermetallic composite layers produced on the Inconel 600 by the glow discharge enhanced-PACVD method. Intermetallics, 2009. 17(12): pp. 1098-1104.
Sitek, R., K. Sikorski, J. Sobczak, and T. Wierzchon, Structure and properties of the multilayers produced on Inconel 600 by the PACVD method with the participation of trimethylaluminum vapours. Materials Science-Poland, 2008. 26(3): pp. 767-777.
Yamanoglu, R., Production and Characterization of Al-xNi in Situ Composites Using Hot Pressing Journal of Mining and Metallurgy Section B-Metallurgy, 2014. 50(1): pp. 45-52.
Sha, M., T. Wang, F. Bai, J. Li, and T. Li, Simulation on solidification of an Al—Ni alloy under electromagnetic stirring. China Foundry, 2012. 9(3): pp. 258-262.
Howell, J.A., S.E. Mohney, and C.L. Muhlstein, Developing Ni—Al and Ru—Al intermetallic films for use in microelectromechanical systems. Journal of Vacuum Science & Technology B, 2011. 29(4): pp. 1-13.
Jiang, T., M.J.C. Brym, G. Dube, A. Lasia, and G.M. Brisard, Electrodeposition of aluminium from ionic liquids: Part I—electrodeposition and surface morphology of aluminium from aluminium chloride (AlCl3)-l-ethyl-3-methylimidazolium chloride ( EMIm CI) ionic liquids. Surface & Coatings Technology, 2006. 201(1-2): pp. 1-9.
Pitner, W.R., C.L. Hussey, and G.R. Stafford, Electrodeposition of nickel-aluminum alloys from the aluminum chloride-1-methyl-3-ethylimidazolium chloride room temperature molten salt. Journal of the Electrochemical Society, 1996. 143(1): pp. 130-138.
Hussey, C.L., T.B. Scheffler, J.S. Wilkes, and A.A. Fannin, Chloroaluminate Equilibria in the Aluminum Chloride-1-Methyl-3-ethylimidazolium Chloride Ionic Liquid. Journal of the Electrochemical Society, 1986. 133(7): pp. 1389-1391.
Yang, C.C. and C.P. Chang, Aluminum Electrodeposition from Room Temperature Molten AlCl3-BPC Salt Bath. Journal of Marine Science and Technology, 1993. 1(1): pp. 31-37.
Gale, R.J., B. Gilbert, and R.A. Osteryoung, Electrochemical and Spectral Investigations of Nickel(II) Ion Equilibria in Room-Temperature Chloroaluminate Solvents Inorganic Chemistry, 1979. 18(10): pp. 2723-2725.
Wilkes, J.S., J.A. Levisky, R.A. Wilson, and C.L. Hussey, Dialkylimidazolium chloroaluminate melts: a new class of room-temperature ionic liquids for electrochemistry, spectroscopy and synthesis. Inorganic Chemistry, 1982. 21(3): pp. 1263-1264.
Roeper, D.F., K.I. Pandya, G.T. Cheek, and W.E. O'Grady, The Structure of Nickel Chloride in the Ionic Liquid 1-Ethyl-3-methyl Imidazolium Chloride/Aluminum Chloride: X-ray Absorption Spectroscopy. Journal of the Electrochemical Society, 2011. 158(3): pp. F21-F28.
Zhao, Y.G. and T.J. VanderNoot, Electrodeposition of aluminium from room temperature AlCl3-TMPAC molten salts. Electrochimica Acta, 1997. 42(11): pp. 1639-1643.
Liu, Q.X., S.Z. El Abedin, and F. Endres, Electroplating of mild steel by aluminium in a first generation ionic liquid: A green alternative to commercial Al-plating in organic solvents. Surface & Coatings Technology, 2006. 201(3-4): pp. 1352-1356.
El Abedin, S.Z., P. Giridhar, P. Schwab, and F. Endres, Electrodeposition of nanocrystalline aluminium from a chloroaluminate ionic liquid. Electrochemistry Communications, 2010. 12(8): pp. 1084-1086.
Ueda, M., H. Ebe, and T. Ohtsuka, Electrodeposition of Al—Cr—Ni layer by pulse electrolysis in AlCl3-EMIC molten salt. Electrochemistry, 2005. 73(8): pp. 739-741.

(56) References Cited

OTHER PUBLICATIONS

Bakkar, A. and V. Neubert, Electrodeposition and corrosion characterisation of micro- and nano-crystalline aluminium from AlCl3/1-ethyl-3-methylimidazolium chloride ionic liquid. Electrochimica Acta, 2013. 103: pp. 211-218.
Li, Q.F., H.A. Hjuler, R.W. Berg, and N.J. Bjerrum, Influence of Substrates on the Electrochemical Deposition and Dissolution of Aluminum in NaAlCl4 Melts. Journal of the Electrochemical Society, 1991. 138(3): pp. 763-766.
Deng, M.-J., I.W. Sun, P.-Y. Chen, J.-K. Chang, and W.-T. Tsai, Electrode position behavior of nickel in the water- and air-stable 1-ethyl-3-methylimidazolium-dicyanamide room-temperature ionic liquid. Electrochimica Acta, 2008. 53(19): pp. 5812-5818.
Tang, J. and K. Azumi, Optimization of pulsed electrodeposition of aluminum from AlCl3-1-ethyl-3-methylimidazolium chloride ionic liquid. Electrochimica Acta, 2011. 56(3): pp. 1130-1137.
Ammar Bin Waqar, Exploration of Electrodeposition of Aluminum-Nickel Alloys and Multilayers in Organic Chloroaluminate Ionic Liquids, 2014. pp. 1-42.

* cited by examiner

ELECTRODEPOSITION OF AL—NI ALLOYS AND AL/NI MULTILAYER STRUCTURES

CROSS-REFERENCE TO RELATED APPLICATION

This application is the 35 U.S.C. § 371 national stage application of PCT Application No. PCT/US2016/044689, filed Jul. 29, 2016, where the PCT claims priority to U.S. Provisional Application Ser. No. 62/199,464, filed Jul. 31, 2015, both of which are herein incorporated by reference in their entireties.

BACKGROUND

Alloys comprising aluminum (Al) and one or more transition metals (TMs) exhibit excellent physical and mechanical properties. Among the various transition metals with which Al can be alloyed, nickel (Ni) is particularly interesting because Al—Ni alloys exhibit excellent corrosion resistance, high temperature oxidation resistance, high strength, good ductility, and magnetic pertinence. In addition to Al—Ni alloys, Al/Ni multilayer structures that comprise alternate layers of Al and Ni are of interest because such structures also exhibit many desirable properties, including easy ignition, self-sustaining exothermic synthesis after reaction, high local temperatures upon propagation (around 1000° C.), and zero emission.

Various processing techniques have been used to synthesize Al—Ni alloys and Al/Ni multilayer structures, including physical vapor deposition (PVD), plasma-assisted chemical vapor deposition (PACVD), hot pressing, and electromagnetic stirring. Not included in this list, however, is electrodeposition. The reason for this is that it is difficult to form Al—Ni alloys and Al/Ni multilayer structures through electrodeposition using a single electrolyte solution. Conventionally, electrodeposition of Ni is performed using an aqueous solution at or near room temperature, while electrodeposition of Al is typically performed using a molten salt electrolyte at high temperature (e.g., ~1000° C.). It is unfortunate that a suitable electrodeposition technique has not been developed for these metal systems because electrodeposition is more economical and easier to scale as compared to the other techniques that have been used. In addition, electrodeposition enables one to easily control the composition and phase of the deposit through adjustment of the deposition parameters, including electrolyte composition, agitation, temperature, and current/potential.

In view of the above discussion, it can be appreciated that it would be desirable to be able to form Al—Ni alloys and/or Al/Ni multilayer structures through electrodeposition.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figures 1A, 1B, 1C:
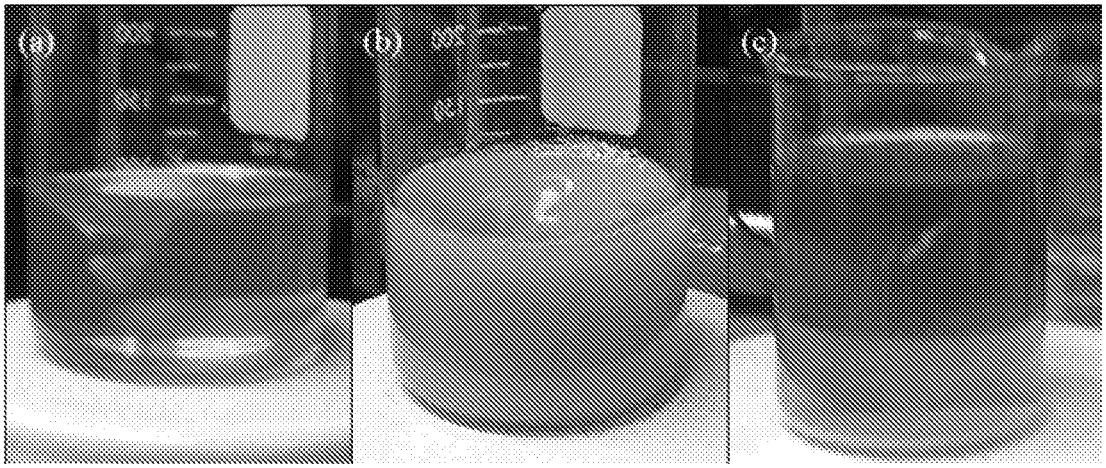
FIGS. 1A-1C are photographs of (A) a 2:1 $AlCl_3$:EMIM electrolyte under agitation, (B) a bright orange $AlCl_3$-EMIM-$NiCl_2$ suspension, and (C) $AlCl_3$-EMIM-$NiCl_2$ with undissolved $NiCl_2$ at the bottom.

As described above, it would be desirable to be able to form aluminum-nickel (Al—Ni) alloys and/or aluminum/nickel (Al/Ni) multilayer structures through electrodeposition. Disclosed herein are methods for forming such alloys and structures through electrodeposition using a single electrolyte solution. In some embodiments, Al—Ni alloys are electrodeposited at room temperature using an electrolyte comprising a solution of aluminum chloride ($AlCl_3$), nickel chloride ($NiCl_2$), and an organic halide. In some embodiments, Al/Ni multilayer structures are formed by first depositing Ni and then depositing Al on the nickel using a single electrolyte solution comprising $AlCl_3$, $NiCl_2$, and a an organic halide. In some embodiments, the organic halide can be selected from the group consisting of 1-ethyl-3-methylimidazolium chloride (EMIM), N-[n-Butyl] pyridinium chloride (BPC), and trimethylphenylammonium chloride (TMPAC).

In the following disclosure, various specific embodiments are described. It is to be understood that those embodiments are example implementations of the disclosed inventions and that alternative embodiments are possible. All such embodiments are intended to fall within the scope of this disclosure.

Electrodeposition in non-aqueous room-temperature solutions or ionic liquids provides a cost-effective alternative to fabricating Al alloys and multilayer structures. As used herein, the term "multilayer structure" is used to describe any structure comprising multiple alternating layers of materials, including "bilayer" structures that comprise two alternate layers of material and structures that comprise three or more layers of alternating material. Room temperature ionic liquids synthesized by adding $AlCl_3$ to an organic halide provides useful and attractive characteristics, such as adjustable Lewis acidity, wide electrochemical window, aprotic nature, room-temperature stability, good conductivity, and low vapor pressure. $AlCl_4^-$ and $Al_2Cl_7^-$ unsaturated species are present in the electrolyte while the concentration of the latter increases with electrolyte acidity. The acid-base characteristic of this melt is represented by the reaction, $$2AlCl_4^- \leftrightarrow Al_2Cl_7^- + Cl^-. \quad (1)$$

In $AlCl_3$-EMIM electrolyte, Al electrodeposition can only be successful in an acidic solution because the formation of the electroactive $Al_2Cl_7^-$ is formed only when the molar fraction of $AlCl_3$ becomes larger than 0.5. In basic $AlCl_3$-EMIM solutions, the only electroactive specie is $AlCl_4^-$, whose reduction potential is more negative than the breakdown potential of the organic cation from the electrolyte. The electrochemically active $Al_2Cl_7^-$ unsaturated ion reduces to Al at the cathode according to the following reaction, $$4Al_2Cl_7^- + 3e^- \leftrightarrow Al + 7AlCl_4^-. \quad (2)$$

For Al—Ni electrodeposition, $AlCl_3$-EMIM-$NiCl_2$ of desired molarity is required. Previous studies suggest that $NiCl_2$ is difficult to dissolve in acidic $AlCl_3$-BPC, while it is readily dissolved in basic melt. However, there have only been a few studies on the behavior of the dissolution of $NiCl_2$ in $AlCl_3$-EMIM and its electrochemical properties. Described below is the electrochemistry of Al—Ni deposition, the parameters that affect the alloy composition and microstructure, and synthesis and electrochemical properties of room-temperature electrolytes (molten salts) that can be used to produce electrodeposited Al—Ni alloys and Al/Ni multilayer structures. The electrolytes comprise an ionic solution including $AlCl_3$, $NiCl_2$, and an organic halide, such as $AlCl_3$-EMIM-$NiCl_2$.

Electrodeposition experiments were performed using a three-electrode setup inside an argon-filled glovebox (Mbraun Labstar, $H_2O$ and $O_2$<1 ppm). A Gamry Reference 600 potentiostat was used for electrodeposition and cyclic voltammetry measurements. Acidic metal bases, including anhydrous aluminum chloride ($AlCl_3$, 99.999%, Aldrich) and anhydrous nickel chloride ($NiCl_2$, 99%, Alfa Aesar), were used as-received. 1-Ethyl-3-methylimidazolium chloride (EMIM, >98%, Lolitec) was heated at 60° C. for 3 days under vacuum to remove excess moisture. Al plate (99.99%, Alfa Aesar) and Al wire (99.99%, Alfa Aesar) were used as the counter and reference electrodes, respectively, unless specified otherwise. Three different materials: copper (Cu) plate (99.99%, Online Metals, 25×15×1 mm), Al plate (99.99%, Alfa Aesar, 25×15×1 mm), and tungsten (W) wire (99.99%, Sigma Aldrich, 1 mm diameter) were employed as the working electrodes. The exposed areas of the Al and Cu working electrodes were limited to 2.25 $cm^2$ by covering the remainder of the areas with epoxy or electrochemical stop liquor. The Al electrodes were polished with 180-grit silicon carbide (SiC) paper and then dipped in an acid solution of 70% $H_3PO_4$, 25% $H_2SO_4$ and 5% $HNO_3$ (by volume) for 10 minutes to remove the native oxides from the Al surface. The Cu electrodes were pretreated in an acid solution of 10% $H_2SO_4$ and 90% water ($H_2O$) (by volume) for 30 seconds. The W electrode was used as received. The deposited structures were characterized using scanning electron microscopy (SEM) (Hitachi SU-70) and energy-dispersive X-ray spectroscopy (EDS) (EDAX-Phoenix). A cross-section of an Al/Ni bilayer was obtained by ion milling using focused ion beam microscopy (FIB) (FEI Quanta 200).

Figures 2A, 2B:
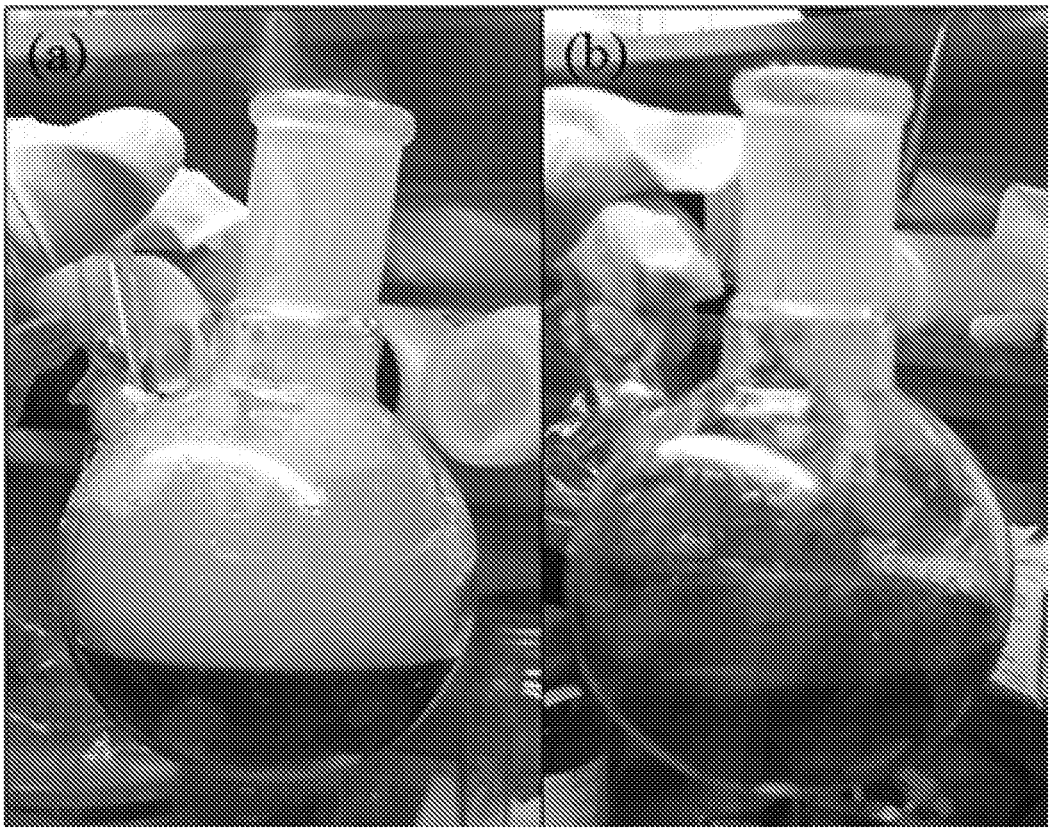
FIGS. 2A and 2B are photographs of (A) a basic $NiCl_2$-EMIM-$AlCl_3$ solution and (B) and acidic $AlCl_3$-EMIM-$NiCl_2$ solution.

To study the dissolution behavior of $NiCl_2$ in $AlCl_3$-EMIM, 0.01 M $NiCl_2$ was first directly added to a 2:1 molar ratio of $AlCl_3$-EMIM electrolyte. After 24 hours of stirring, the clear electrolyte (FIG. 1A) turned into a bright orange suspension (FIG. 1B). Leaving the electrolyte unstirred for 24 hours caused the undissolved particles to settle at the bottom of the beaker (FIG. 1C). These observations reveal the low solubility of $NiCl_2$ in acidic chloroaluminate electrolyte. The $NiCl_2$ was readily dissolvable, however, in basic $AlCl_3$-EMIM electrolyte. A desired amount of $NiCl_2$ was first added to EMIM. $AlCl_3$ was then slowly added to the mixture. $AlCl_3$ immediately reacts with EMIM leading to an acid-base reaction. This reaction is exothermic, accompanied by the release of white fumes. When the molar fraction of $AlCl_3$ (i.e. $[AlCl_3]/[AlCl_3]+[EMIM]$) is less than 0.5, the solution formed was basic which favors the dissolution of $NiCl_2$. A clear green solution was observed, as shown in FIG. 2A. Increasing $NiCl_2$ from 0.026 to 0.1 M changes the solution color from green to blue. As soon as the molar fraction of $AlCl_3$ reaches 0.5, the solution turns brown as seen in FIG. 2B, indicating a shift from basic to acidic solution.

Further addition of $AlCl_3$ was performed to shift the reduction potential of Al to support its deposition. It was noticed that $AlCl_3$ was easily dissolved beyond 1:1 molar ratio of $AlCl_3$:EMIM but could not reach 2:1 as excess $AlCl_3$ precipitated without dissolution. This can be understood by the fact that $Ni_2^+$ ions consume some of the EMIM anions making less available reactive anions for $Al_3^+$ cations. Thus, the molarity ratio of the $AlCl_3$:EMIM was limited to 1.5:1 for all experiments. The resultant electrolyte (hereafter referred as $NiCl_2$-EMIM-$AlCl_3$ electrolyte) was a clear brown solution and was used without further purification.

Figure 3:
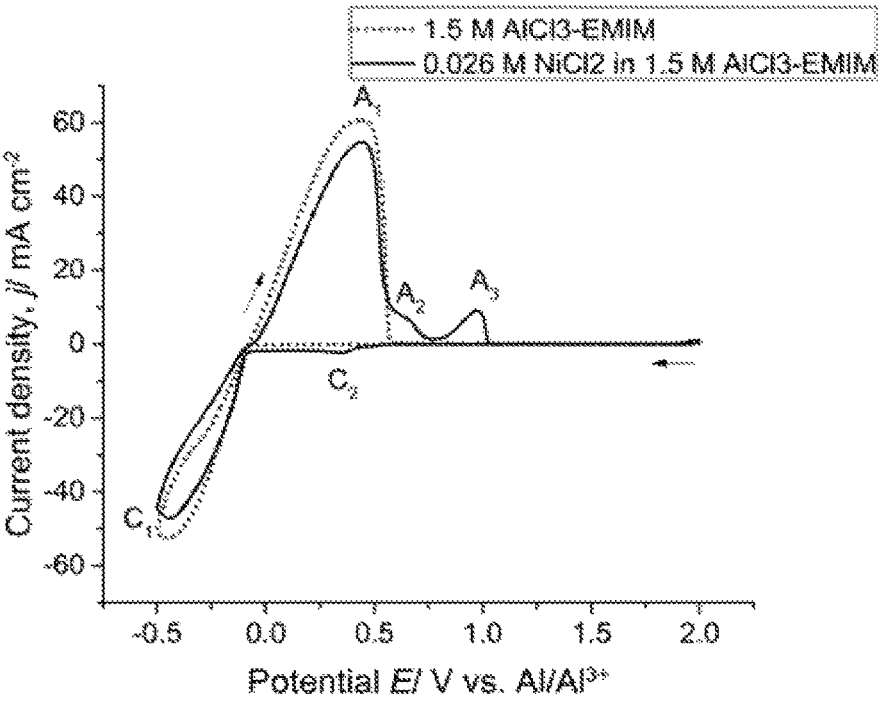
FIG. 3 is a graph showing cyclic voltammograms on W electrodes measured with scan rate of 20 mV/s with a step size of 2 mV in $AlCl_3$-EMIM compared with $AlCl_3$-EMIM containing 0.026 mol $L^{-1}$ $NiCl_2$.
Figure 4:
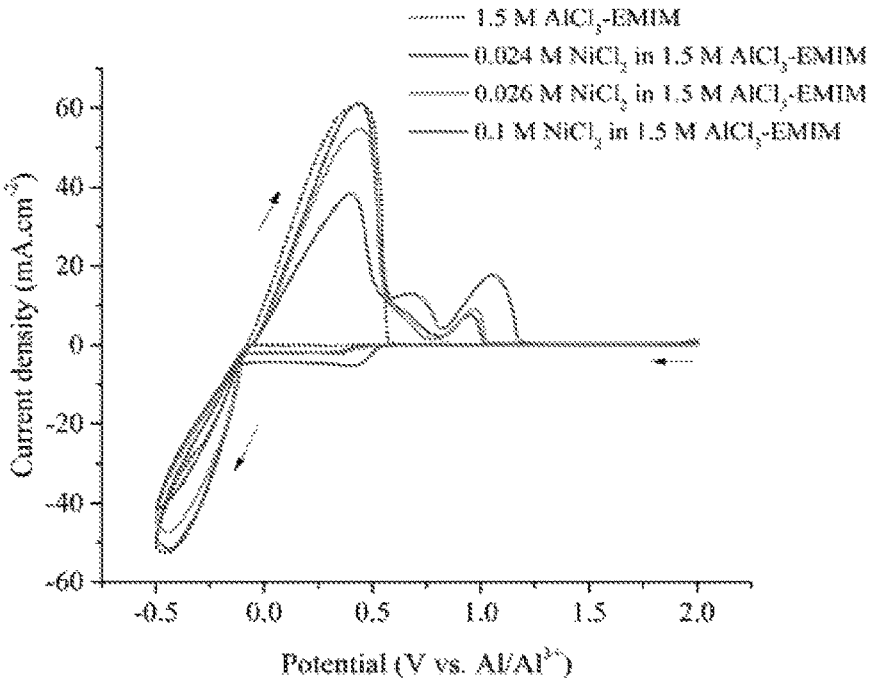
FIG. 4 is a graph showing a comparison of cyclic voltammograms on W electrodes in $AlCl_3$-EMIM, $AlCl_3$-EMIM containing 0.024 mol $L^{-1}$ $NiCl_2$, $AlCl_3$-EMIM containing 0.026 mol $L^{-1}$ $NiCl_2$, and $AlCl_3$-EMIM containing 0.1 mol $L^{-1}$ $NiCl_2$ measured with scan rate of 20 mV/s with a step size of 2 mV.

A voltage sweep starting from 2 V versus $Al/Al_3^+$ to −0.5 V and reversed back to 2 V was applied to determine the oxidation and reduction peaks suggesting dissolution and deposition of the respective metals or alloys, respectively. The peak shapes in the voltammograms depicted in FIG. 3 are consistent with those illustrated for $AlCl_3$-EMIM and $AlCl_3$-EMIM-$NiCl_2$. A reduction wave $C_1$ and an oxidation peak $A_1$ with a peak potential at 0.44 V is observed in the voltammogram of $AlCl_3$-EMIM, which is attributed to the bulk deposition and bulk stripping of Al, respectively. Al reduction started at −130 mV versus $Al/Al_3^+$ revealing the need of a relatively large nucleation overpotential. The electrolyte with 0.026 $mol^{-1}$ shows additional peaks $C_2$ at 0.4 V attributed to the deposition of bulk Ni, as confirmed by EDS analysis. The constant cathodic peak ranging from −0.12 to 0.3 V can be attributed to the deposition of intermetallic Al—Ni alloys since this range corresponds to their deposition potential range, which is 0.08 to −0.2 V. Peaks $A_2$ and $A_3$ correspond to the relative stripping of Al—Ni intermetallic and bulk Ni, respectively. It can be clearly stated that the amount of $NiCl_2$ dissolved in the melt is in direct proportionality with the intensities of $C_2$, $A_2$, and $A_3$ peaks due to more $Ni_2^+$ ions available in the electrolyte, as shown in FIG. 4.

Figure 5:
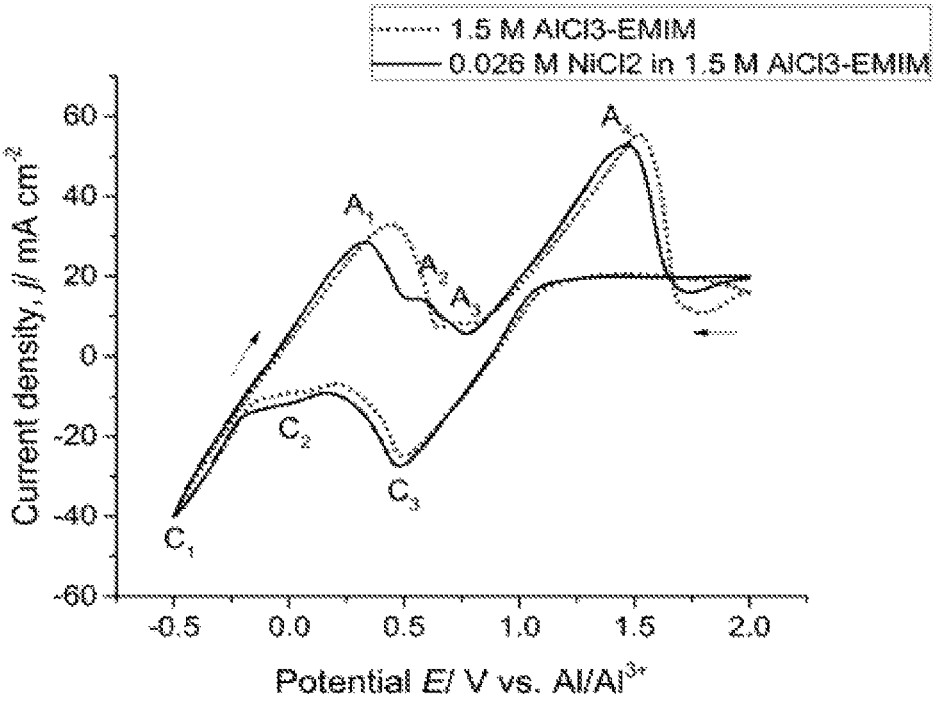
FIG. 5 is a graph showing cyclic voltammograms on W electrodes measured with scan rate of 20 mV/s with a step size of 2 mV in $AlCl_3$-EMIM compared with $AlCl_3$-EMIM containing 0.026 mol $L^{-1}$ $NiCl_2$.
Figure 6:
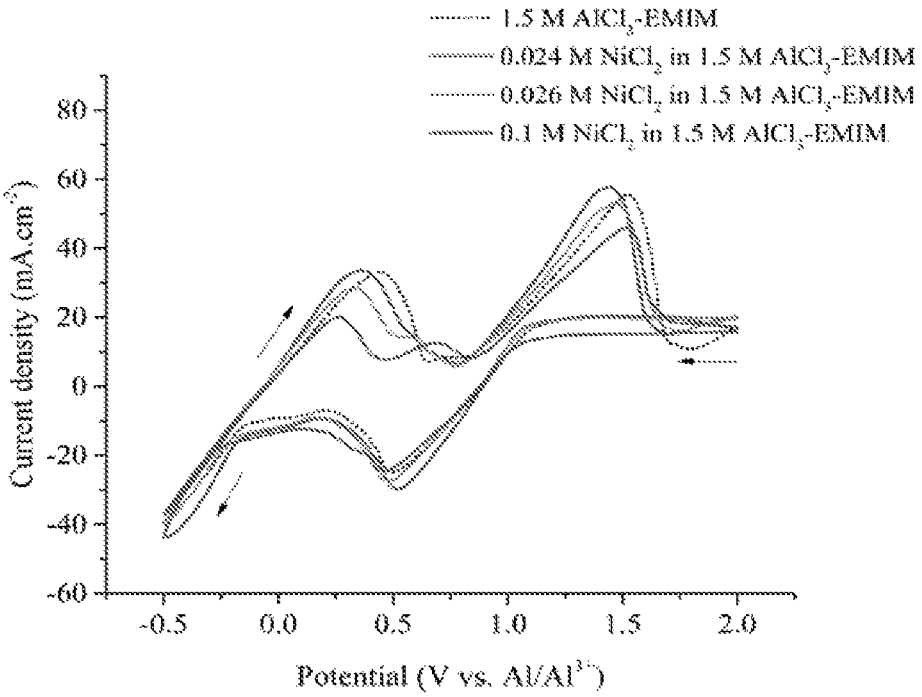
FIG. 6 is a graph showing a comparison of cyclic voltammograms on Cu electrodes in $AlCl_3$-EMIM, $AlCl_3$-EMIM containing 0.024 mol L−1 $NiCl_2$, $AlCl_3$-EMIM containing 0.026 mol $L^{-1}$ $NiCl_2$, and $AlCl_3$-EMIM containing 0.1 mol L−1 $NiCl_2$ measured with scan rate of 20 mV/s with a step size of 2 mV.

Cyclic voltammetry with similar parameters was conducted on the Cu electrode to study the variations in the peak potentials for Al and Ni deposition shown in FIG. 5. Unlike inert W, Cu is electrochemically active, thus an anodic potential versus the aluminum reference electrode is observed until the first reduction peak, which represents constant dissolution of Cu in the electrolyte. The peak $C_1$ on the scan attributed to the reduction of Al reveals that the deposition of Al starts at −0.2 V, which deviated slightly from the $C_1$ on W. Consequently, the peak $A_1$ corresponds to the oxidation of bulk Al where Al is completely stripped away from the substrate. The reduction peak $C_3$ at 0.5 V conforms to the deposition of Cu as it lies in proximity of the standard reduction potential of Cu. Cu undergoes oxidation represented by the $A_4$ peak at 1.5 V since the Cu electrode etched away at this potential. Minor oxidation and reduction peaks $A_2$ and $C_2$ are related to the underpotential stripping and deposition of Al on the Cu substrate. The reduction potential of Al—Ni intermetallics and bulk Ni did not vary significantly and were found to be 0 and 0.3 V respectively. Ni and Al—Ni peaks increase with the increasing amount of $NiCl_2$ dissolved in the melt, as shown in FIG. 6. The increase in the Ni peaks are counterbalanced by the evident decrease in the Al peaks owing to the reduced dissolution of $AlCl_3$ in the electrolyte.

Figure 7:
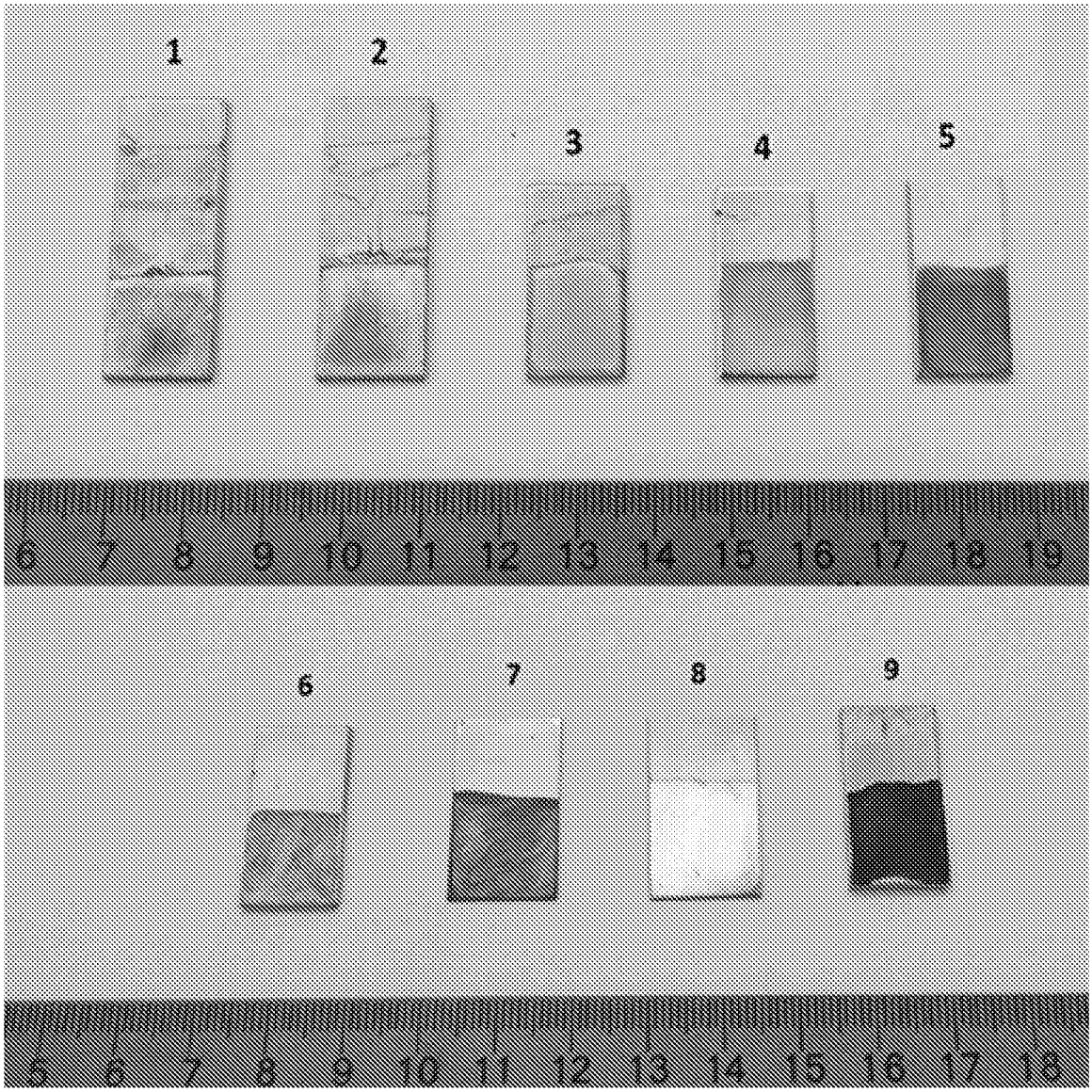
FIG. 7 is a photograph showing multiple electrodeposited samples (Samples 1-9).

A number of samples with different parameters were deposited to study the effect of deposition potentials, duty ratios, and frequencies on alloy composition, as shown in FIG. 7. The deposition parameters for each sample and their EDS results are tabulated in Table 1.

twice the amount of Ni in the deposited alloy. With frequencies of 1 and 0.5 Hz, the deposition of Al and Ni takes place for 0.5 second and 1 second in each cycle, respectively. Since Ni deposition occurs via three-dimensional progressive nucleation, with more time for each cycle in the 0.5 Hz frequency, the current transient draws more current in 1 second as compared to that drawn in 2 cycles of 0.5 seconds in 1 Hz frequency. This increased current density on the Ni deposition cycle results in the increased Ni content.

Sample 7 was deposited on a smooth electrodeposited Cu substrate with the same potential, frequency, duty ratio, and electrolyte as Sample 5, which was deposited on a relatively rougher Cu substrate. Ni concentration was found to increase from 6 to 17.7 at. % using a smoother surface. The electrodeposited Cu substrate provides a much smoother surface with nano-scale roughness, which might favor metal nucleation resulting in better adherence of the Ni particles.

TABLE 1

Electrodeposition parameters and composition of deposits.

| Sample | Amount of $NiCl_2$ in $AlCl_3$-EMIM (M) | Substrate | Negative Potential (V) | Positive Potential (V) | Duty cycle ratio of negative to positive | Frequency f (Hz) | Deposition (s) | Concentration (wt. %) Al | Concentration (wt. %) Ni | Concentration (at. %) Al | Concentration (at. %) Ni |
|---|---|---|---|---|---|---|---|---|---|---|---|
| 1 | 0.024 | Cu | −0.3 | 0.15 | 9::1 | 1 | 3600 | 94.3 | 5.7 | 97.3 | 2.7 |
| 2 | 0.026 | Cu | −0.5 | 0.4 | 4:1 | 1 | 3600 | 95.8 | 4.2 | 98.1 | 1.9 |
| 3 | 0.26 | Cu | −0.3 | 0.15 | 1::1 | 1 | 7200 | 95.7 | 4.3 | 98 | 2 |
| 4 | 0.026 | Cu | −0.3 | 0.15 | 1::1 | 0.5 | 7200 | 90.4 | 9.6 | 95.3 | 4.7 |
| 5 | 0.1 | Cu | −0.3 | 0.15 | 1::1 | 1 | 7200 | 87.8 | 12.2 | 94 | 6 |
| 6 | 0.1 | Cu | −0.3 | 0.15 | 9:11 | 1 | 7200 | 94.1 | 5.9 | 97.2 | 2.8 |
| 7 | 0.1 | Electrodeposited Cu | −0.3 | 0.15 | 1::1 | 1 | 3600 | 68.2 | 31.8 | 82.3 | 17.7 |
| 8 | 0.026 | Electrodeposited | −0.3 | | — | — | 150 | Pure Al | | | |
| 9 | 0.026 | Cu | 0.4 | | — | — | 375 | Pure Ni | | | |

Samples 3 and 5 were deposited using the same potential, duty cycle ratio, and frequency in $AlCl_3$-EMIM containing 0.026 M and 0.1 M of $NiCl_2$, respectively. The Ni concentration increased nonlinearly from 2 to 6 at. % as the amount of $NiCl_2$ increased due to the availability of more Ni and fewer Al ions shown by their peaks in the CV. This nonlinear proportionality with a much greater deviation can also be observed when comparing samples 1 and 6.

Samples 5 and 6 with duty ratios 1:1 and 9:1, respectively, were deposited in $AlCl_3$-EMIM containing 0.1 M $NiCl_2$ using the same potentials. It was observed that the Al and Ni contents increased with increasing the time of the positive and negative cycles of the pulse, respectively. In Sample 5, the 9:1 ratio potential pulse spends most of the time in the negative cycle at −0.3 V responsible for depositing Al, while the positive pulse, which is just 1/10th of the total cycle, decreases the time for the deposition of Ni and stripping of Al. On the contrary, in Sample 6, the 1:1 ratio provides more time for Ni to be deposited. Also, since the reduction potential of Ni lies in close proximity of the oxidation potential of Al, Al stripping accompanies Ni deposition, resulting in lesser amount of Al in the mix.

Figures 8A, 8B, 8C, 8D, 8E, 8F:
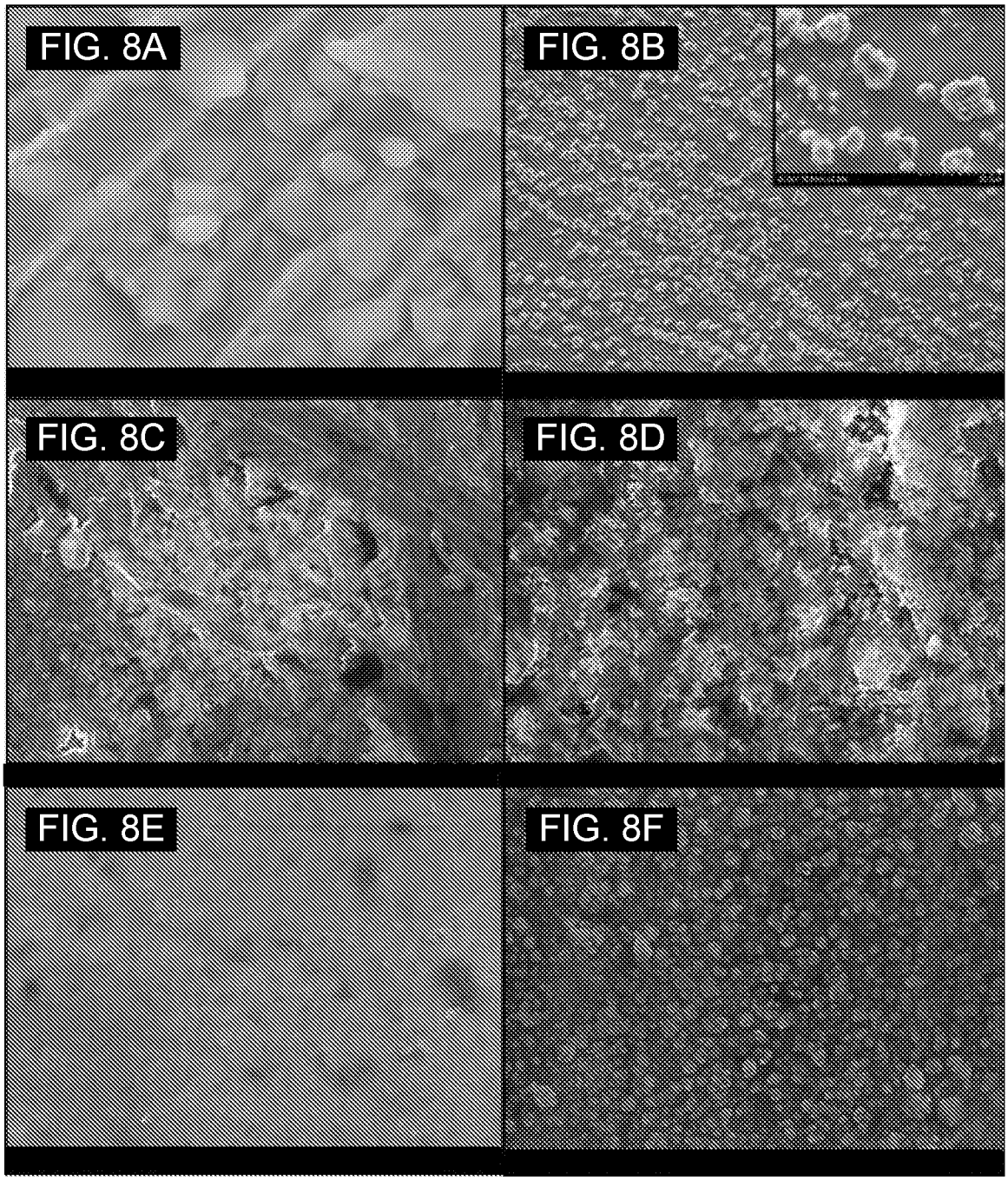
FIGS. 8A-8F are scanning electron microscope (SEM) images of (A) Sample 1, (B) Sample 2, (C) Sample 3, (D) Sample 5, (E) pure Al deposit at −0.3 V in 1.5:1 M $AlCl_3$-EMIM containing 0.026 M $NiCl_2$, and (F) pure Ni deposit at 0.4 V in 1.5:1 M $AlCl_3$-EMIM containing 0.1 M $NiCl_2$.

The effect of frequency on the Al—Ni composition can be analyzed using Samples 3 and 4 deposited with frequencies 1 and 0.5 Hz with the same electrolyte, potential, and duty ratio. Decreasing the frequency by half resulted in almost The SEM image of Sample 1 in FIG. 8A shows dense nodular structures consistent with previous studies. Sample 2 shows a columnar surface morphology with widely spread nodules, as shown in FIG. 8B. A close examination on the inset image of FIG. 8B reveals the presence of smaller nodules in the range of 10 to 15 μm with a cauliflower like appearance consistent with previous work. The cauliflower structure appears due to higher deposition rate with the increase of potential. Samples 3 and 5 show coarse flake-like structures in FIGS. 8C and 8D. A study suggests that the increase in the thickness of the deposit makes the surface of Al—Ni rougher. This was not found to be the case since Sample 7, deposited with the same parameters as Sample 5 but on smooth Cu substrate, also inhibited the flake structure. Also, this structure seems to be independent of the molarity of $NiCl_2$ in the melt since it was different for Sample 3. The formation of these flakes is not related to the potential used since Sample 1 uses the same potential but formed columnar structure. At the same time, it is not due to the frequency since Samples 1 and 2 have the same frequency. The only parameter that all of the flake structured deposits have in common is the duty ratio. These results indicate that the increased time for the Ni deposition and Al stripping in the positive cycle of the pulse affects the microstructure. Al deposits generally have nodular morphology but they have also been reported to form flake structures, while Ni deposits have been shown to have columnar cauliflower structures. The observed flake structures of the Al—Ni deposits appear to be a hybrid of the flake Al and cauliflower Ni. Dense and compact pure Al and Ni were also deposited having fine crystalline and nodular cauliflower microstructures, respectively.

Figure 9:
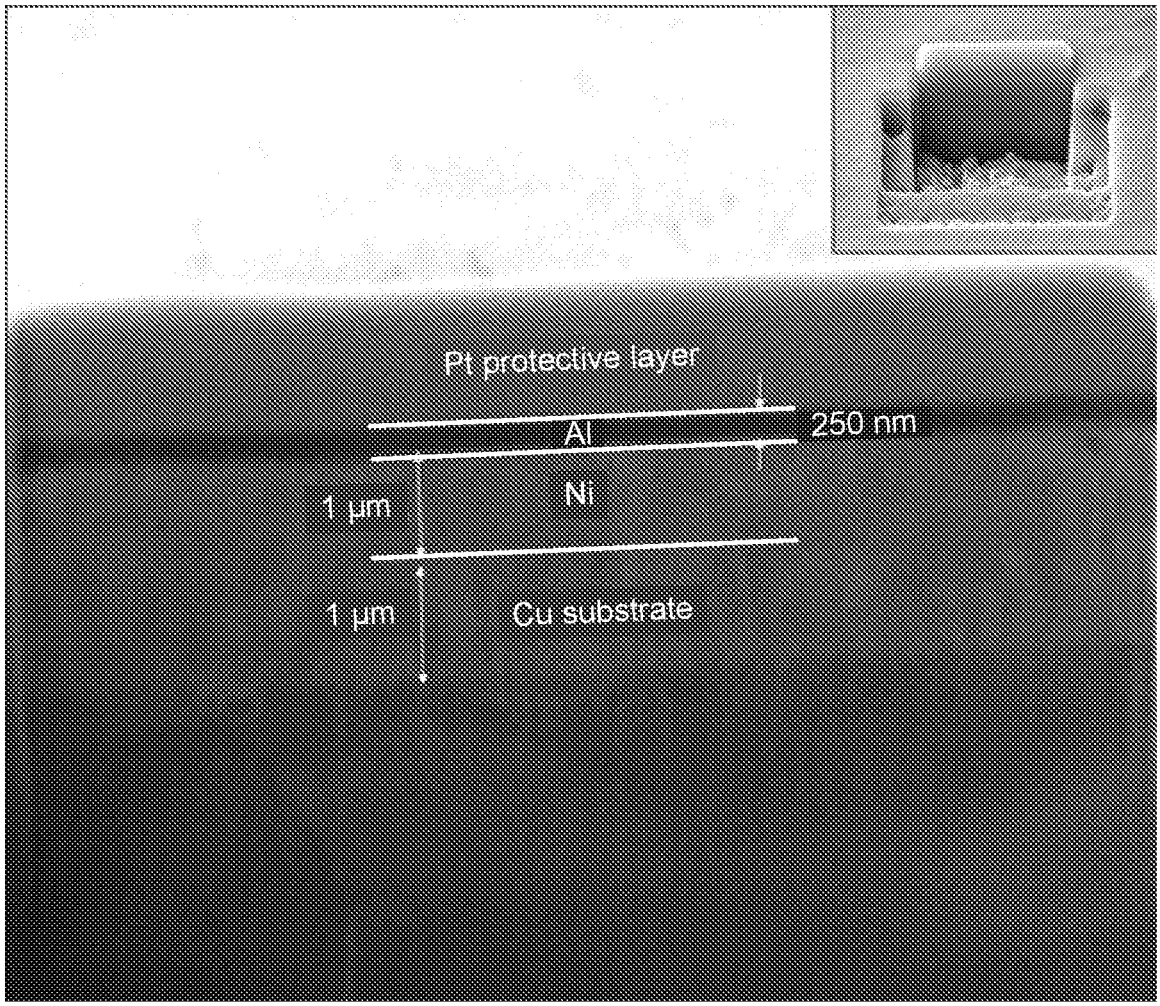
FIG. 9 is a SEM image of a focused ion beam (FIB) cross-section of Ni/Al bilayer sample.

Application of this system to Al/Ni bilayers was also tested and revealed useful results. A successful bilayer sample with Ni deposited on electrodeposited Cu with a pulse potential of 0 and 0.78 V for 800 seconds, and Al deposited at a constant −0.3 V for 150 seconds in $AlCl_3$-EMIM containing 0.026 M $NiCl_2$ was prepared. The first cycle of the pulse potential waveform for the deposition of Ni was set to 0V. 0.78 V for the second cycle was chosen as the potential where the current becomes zero from voltammogram in FIG. 5. This waveform was selected to promote progressive nucleation of Ni in each cycle as opposed to a constant potential, which imparts diffusion-controlled growth of Ni nuclei. A cross-section of the Ni/Al bilayer was milled using FIB imaging, as shown in FIG. 9. A clear color contrast between the darker Al and brighter Ni layers is observed. However, the difference in color contrast between Ni and Cu is not clearly visible since their atomic numbers differ only by 1. The known thickness of the electrodeposited Cu is 1 μm. From this, the thickness of Ni layer was estimated to be 1 μm while that of Al was 250 nm. The darker region beneath the electrodeposited Cu is the substrate.

As described in the foregoing discussion, electrodeposition of Al—Ni alloys and Al/Ni multilayer structures have been successfully demonstrated. Dissolution of $NiCl_2$ in an $AlCl_3$-EMIM room-temperature melt was found to be favorable in basic electrolyte. A detailed study on the electrochemical properties of the electrolyte using cyclic voltammetry has been performed. The use of an electrochemically active Cu working electrode effects the electrochemistry of the electrolyte by dissolving Cu in the scan range of 1 to 2 V and introducing additional oxidation and reduction peaks pertaining to the stripping and deposition of Cu. The current density of Ni and Al oxidation and reduction peaks vary directly and indirectly to the amount of $NiCl_2$ dissolved in the $AlCl_3$-EMIM electrolyte respectively. The concentration of Ni in the Al—Ni alloys increased with the increase in amount of $NiC_2$ dissolved in the melt, increase in the time period of positive potential cycle, decrease in frequency, and decrease in surface roughness of the working electrode. The Al—Ni alloys typically showed nodular morphology with a cauliflower structure. Flake structures, which were independent of surface roughness, were found to develop for a 1:1 duty ratio. XRD on the Al—Ni alloys suggests the presence of supersaturated FCC crystalline solid solution of Al and Ni. A uniform Al/Ni bilayer was successfully deposited in 1.5:1 $AlCl_3$-EMIM containing 0.026 M $NiCl_2$. Deposition of Al on Ni was achieved.

Figure 10:
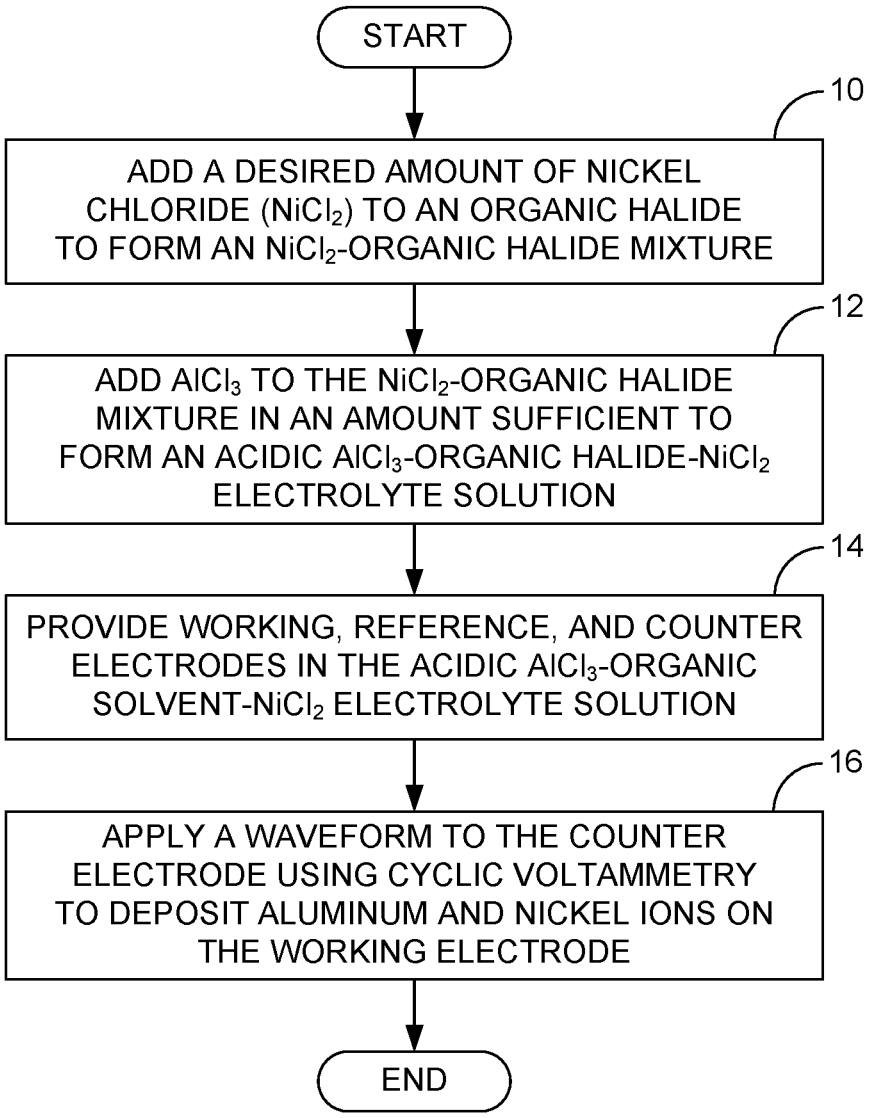
FIG. 10 is a flow diagram of an embodiment of a method for electrodepositing aluminum and nickel using a single electrolyte solution.

FIG. 10 is a flow diagram of an embodiment of a method for electrodepositing Al and Ni (i.e., Al—Ni alloys or Al/Ni multilayer structures) using a single electrolyte solution that is consistent with the above-described electrodeposition methods. Beginning with block 10, a desired amount of $NiCl_2$ is first added to an organic halide to obtain a $NiCl_2$-organic halide mixture. The amount of $NiCl_2$ that is added may depend on the nature of the alloy or multilayer structure that is to be formed. By way of example, the organic halide can comprise EMIM.

Referring next to block 12, $AlCl_3$ is added to the $NiCl_2$-organic halide mixture to obtain an $AlCl_3$-organic halide-$NiCl_2$ electrolyte solution. As described above, when the electrolyte solution contains small amounts of $AlCl_3$, the electrolyte solution is basic. When the molar fraction of $AlCl_3$ reaches 0.5 or greater, however, the electrolyte solution becomes acidic, which facilitates electrodeposition of Al. Accordingly, the $AlCl_3$ is added in an amount sufficient to change the $AlCl_3$-organic halide-$NiCl_2$ electrolyte solution from a basic electrolyte solution to an acidic electrolyte solution. Accordingly, $AlCl_3$ is added until the molar fraction of $AlCl_3$ within the solution is 0.5 or greater. In some embodiments, $AlCl_3$ is added to the electrolyte solution until a molar ratio of $AlCl_3$:organic halide is 1.5:1. In some embodiments, the $NiCl_3$ is added to the electrolyte solution until a molar ratio of $NiCl_3$:$AlCl_3$-organic halide is 0.024 to 0.1.

With reference next to block 14, working, reference, and counter electrodes can be provided (immersed) in the acidic $AlCl_3$-organic halide-$NiCl_2$ electrolyte solution and, with reference to block 16, a waveform is applied to the counter electrode using cyclic voltammetry to deposit Al and Ni on the working electrode. The various parameters of the cyclic voltammetry, such as the applied potential, the frequency, the duty cycle ratio, and time, can be selected depending upon the alloy or multi-layer structure that is desired. Notably, however, the electrolyte solution need not be heated and, therefore, electrodeposition can be performed at room temperature.

The invention claimed is:

1. A method for electrodepositing aluminum and nickel using a single electrolyte solution, the method comprising:
- forming a mixture consisting of nickel chloride and an organic halide;
- adding aluminum chloride to the mixture in an amount at which the molar fraction of aluminum chloride within the mixture is 0.5 or greater such that the mixture becomes an acidic electrolyte solution;
- providing a working electrode and a counter electrode in the acidic electrolyte solution; and
- applying a waveform to the counter electrode using cyclic voltammetry to cause aluminum and nickel ions to be deposited on the working electrode;
- wherein the acidic electrolyte solution is not heated and the deposition of aluminum and nickel ions is performed at room temperature.

2. The method of claim 1, wherein the organic halide comprises 1-ethyl-3-methylimidazolium chloride.

3. The method of claim 1, wherein the organic halide comprises N-[n-Butyl] pyridinium chloride.

4. The method of claim 1, wherein the organic halide comprises trimethylphenylammonium chloride.

5. The method of claim 1, wherein forming a mixture comprises forming a mixture comprising approximately 0.024 to 0.1 M of nickel chloride.

6. The method of claim 1, wherein adding aluminum chloride comprises adding aluminum chloride in a molar ratio of aluminum chloride:organic halide that is no greater than 1.5:1.

7. The method of claim 1, wherein providing a working electrode comprises providing an aluminum, copper, or tungsten electrode in the acidic electrolyte solution.

8. The method of claim 1, wherein applying a waveform comprises applying a potential of approximately −0.3 V to 0.4 V.

9. The method of claim 1, wherein applying a waveform comprises applying a waveform having a duty cycle ratio of approximately 1::1 to 9::1.

10. The method of claim 1, wherein applying a waveform comprises applying a waveform having a frequency of approximately 0.5 to 1 Hz.

11. The method of claim 1, wherein applying a waveform comprises applying the waveform for approximately 150 to 7200 seconds.

12. The method of claim 1, wherein applying a waveform comprises applying the waveform in a manner in which an aluminum-nickel alloy is deposited on the working electrode.

13. The method of claim 12, wherein the aluminum-nickel alloy comprises at least approximately 90% aluminum by weight percentage.

14. The method of claim 1, wherein applying a waveform comprises applying the waveform in a manner in which a multilayer structure is formed having alternating layers of aluminum and nickel.

* * * * *